US005613871A

United States Patent [19]

Akeda

[11] Patent Number: 5,613,871

[45] Date of Patent: Mar. 25, 1997

[54] PINCH PREVENTIVE CONNECTOR

[75] Inventor: Nobuyuki Akeda, Haibara-gun, Japan

[73] Assignee: Yazaki Corporation, Tokyo, Japan

[21] Appl. No.: 357,759

[22] Filed: Dec. 16, 1994

[30] Foreign Application Priority Data

Dec. 28, 1993 [JP] Japan ..... 5-337559

[51] Int. Cl.[6] ..... H01R 13/64

[52] U.S. Cl. ..... 439/374

[58] Field of Search ..... 439/374, 676, 439/677, 357, 364, 376

[56] References Cited

U.S. PATENT DOCUMENTS

| | | | |
|---|---|---|---|
| 4,957,449 | 9/1990 | Hatagishi | 439/364 |
| 4,960,387 | 10/1990 | Davis et al. | 439/374 |
| 5,462,450 | 10/1995 | Kodama | 439/357 |

FOREIGN PATENT DOCUMENTS 63-141579 9/1988 Japan .

*Primary Examiner*—Neil Abrams
*Assistant Examiner*—Eugene G. Byrd
*Attorney, Agent, or Firm*—Armstrong, Westerman, Hattori, McLeland & Naughton

[57] ABSTRACT

This invention relates to a pinch preventive connector comprising a pair of male and female connector housings for coupling electric terminals contained therein and thereby preventing a pinching which damages an electric terminal contained in the female connector housing when the male connector housing is engaged in an inclined state and thereby male connector housing hits against the electric terminal. An outer cover portion is provided on the periphery of the male connector housing in order to prevent an excessive insertion of the male connector housing from entering into the female connector housing for preventing the pinching by way of abutting a pinch preventive end of the outer cover portion against the periphery of the female connector housing when the male connector housing is inclined at the time of insertion to avoid the hitting of the male connector housing against the electric terminal contained in the female connector housing.

7 Claims, 2 Drawing Sheets

PINCH PREVENTIVE CONNECTOR

BACKGROUND OF THE INVENTION

1. Field of the Invention

The present invention relates to a connector comprising of a pair of connector housings to be coupled by insertion, and more particularly to a pinch preventive connector to prevent electric terminals contained in one of the connector housings from damage by improper engagement or from pinching when inserting one connector housing into another.

2. Description of the Related Art

When engaging a male connector housing with a female connector housing, if the male connector housing "b" is engaged with the female connector housing "a" by insertion as being inclined, as shown in FIG. 4, an end of the male connector housing "b" hits against a male electric terminal "c" which is contained in the female connector housing "a" for causing pinching, resulting in a damage of the male electric terminal "c" by pressure.

There has been proposed a connector, which is disclosed in a preliminary publication of Utility Model Application No. 141579/88, wherein a male connector housing "P" is provided with a pinch preventive projection or stopper "d" at the outer surface "b" of the main male connector housing. In accordance with this configuration, the main male connector housing "P" is prevented from excessive entering into the female connector housing "a" by the abutment of pinch stopper "d" against an open end "e" of the female housing "a" even if the main male housing "P" is inserted into the female housing "a" as being inclined, as shown in FIG. 5, and thereby eliminating the hitting of the main male housing "P" against the male electric terminal "c" within the female housing "a" for preventing the pinching from being caused.

Further, a connector housing Q has been proposed, wherein the pinching has also been prevented from causing through the elimination of an excessive insertion of a male connector housing "b" into a main female housing "a'" with use of a pinch preventive projection "f", as shown in FIG. 6.

The above-described male connector housing "P", however, has a problem such that it has failed sometimes to prevent pinching from causing due to a fact that the pinch preventive projection or stopper "d" is not always formed into a proper shape since a shape of the pinch protective projection or stopper "d" is restricted by a shape of engaging portion of the counter-housing.

In addition, the connector housing "Q" of the latter case requires a space for the pinch protective projection "f" to be provided at the interior of the main female housing "a'", this results in an enlargement of the connector housing. If it is impossible to enlarge the connector housing in view of relative configuration of parts in use, the pinch preventive projection "f" cannot be provided. Therefore, this kind of connector housing "Q" has also had a problem such that it is inappropriate as a countermeasure against pinching.

SUMMARY OF THE INVENTION

In view of the foregoing, it is therefore an object of this invention to provide a pair of pinch protective connector housings which are capable of preventing a pinching from causing without a fail independently of a configuration of the engaging portion.

In accordance with the present invention, there is provided a pair of connector housings engaging with each other, one of which has an outer cover having a pinch preventive end, whereby the connector housing is prevented from hitting against an electric terminal which is contained in the counter connector housing by contacting the pinch preventive end onto the periphery of the counter connector housing at the time when both connector housings are engaged with each other in such a way as being inclined to each other.

Further in accordance with the present invention, a pinch preventive end of an outer cover portion provided on one connector housing contacts the periphery of the other connector housing when both connector housings are engaged in such a way as being inclined to each other in order to avoid an excessive insertion of one connector housing into the other connector housing, thus preventing an end portion of one connector housing from hitting against an electric terminal contained in the other connector housing before causing any damage by the pinching. In this way, the problem encountered by the prior art connectors can be eliminated without fail.

BRIEF DESCRIPTION OF THE DRAWINGS

These and other features and advantages of the invention will be more clearly understood from the following detailed description of the preferred embodiment with reference to the accompanying drawings in which.

DESCRIPTION OF THE PREFERRED EMBODIMENTS

Figure 1:
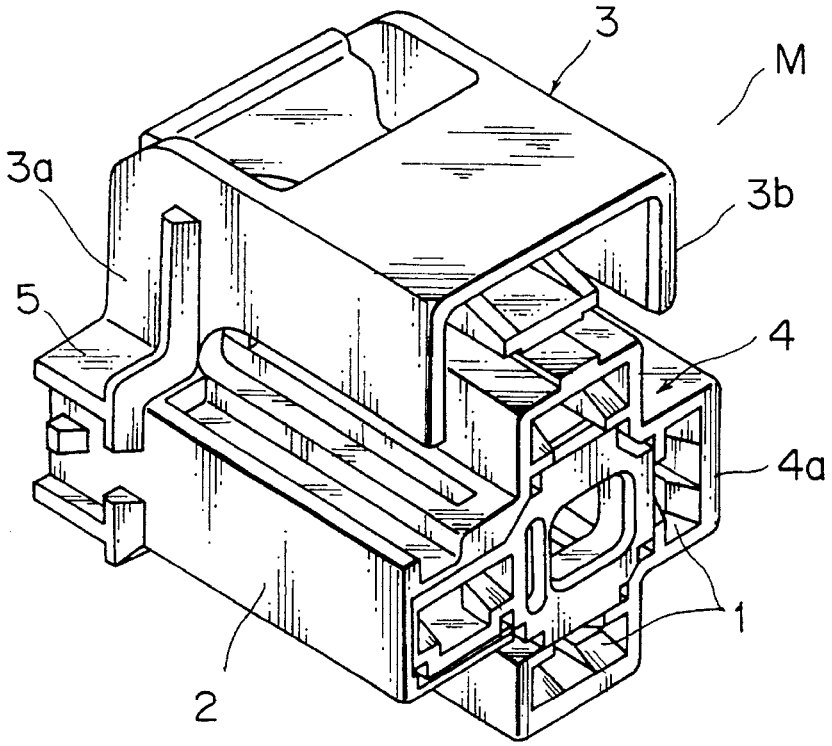
FIG. 1 is a perspective view of a male housing of a preferred embodiment of the present invention.

Referring to FIG. 1, there is shown a perspective view of a male connector housing "M" which is one component of a pair of connector housings that constitutes a pinch preventive connector embodying the present invention.

The male connector housing "M" contains a plurality of terminal containing chambers 1 and has an outer cover portion 3 to be used for pinch prevention at the periphery of a housing shell 2. The outer cover portion 3 can be made an integral part of the housing shell 2.

The outer cover portion 3 is formed into a shape having a concave cross section so as to enclose an engaging portion 4 of the male connector housing "M" and has a pinch preventive end **3*b*. The outer cover portion 3 has a nose portion extending from a vertical base 3*a* provided on a non-engaging portion 5 of the shell 2 which is the other side of the engaging portion 4 of the shell 2**.

Figure 2:
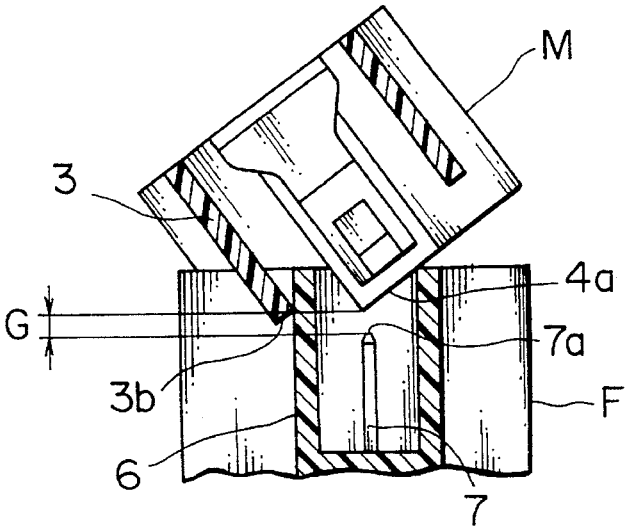
FIG. 2 is an explanatory drawing illustrating a state in which the male housing of FIG. 1 is inserted into a female housing as being inclined.

The pinch preventive end **3*b* of the outer cover portion 3 is set in a position against an end portion 4*a* of the engaging portion 4 of the male connector housing "M" as shown in FIG. 2**.

In other words, the length of the outer cover portion 3 relative to the pinch preventive end 3*b* should be arranged so that a gap "G" is formed between the end portion 4*a* of the male connector housing "M" and the tip end 7*a* of the male electric terminal 7 for preventing engaging end portion 4*a* of the male connector housing "M", with the projecting end of terminal 7, from hitting against the tip end 7*a* of the male electric terminal 7 contained in female connector housing "F" by bringing the pinch preventive end 3*b* of the outer cover portion 3 into contact with the periphery of a shell 6 of the female connector housing "F". Thus, a tilt of the male connector housing "M" is limited to a certain degree in order to prevent further inclination of the male connector housing "M" even if the male connector housing "M" is inserted as being inclined.

Although a larger gap "G" between the engaging end portion 4*a* of the male connector housing "M" and the tip end 7*a* of the male electric terminal 7 provides a more secure countermeasure for preventing pinching from being caused, the larger gap "G" results in an unstable positioning of the male and female connector housings "M" and "F" at the time of engaging the both connector housings, and causes another problem in a process of engagement. It is therefore preferable to determine a size of gap "G" properly according to the geometry of the both housings.

Figure 3:
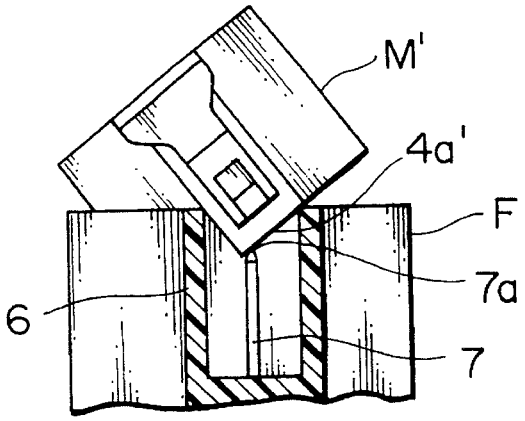
FIG. 3 is an explanatory drawing illustrating a state in which a male housing having no outer cover portion is inserted into the female housing of FIG. 2.
Figure 4:
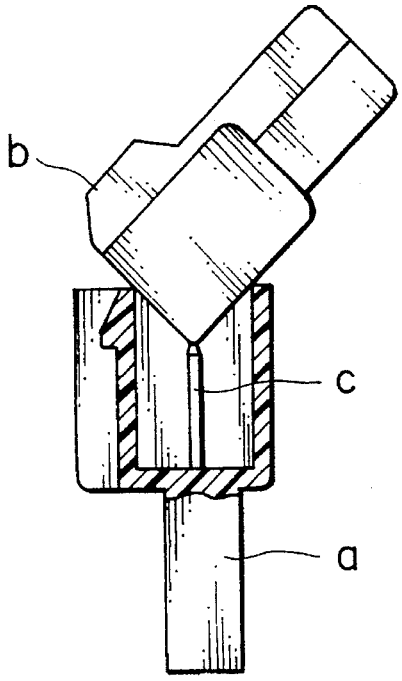
FIG. 4 PRIOR ART
FIG. 4 is an explanatory drawing illustrating a pinching when engaging conventional male and female housings with each other.
Figure 5:
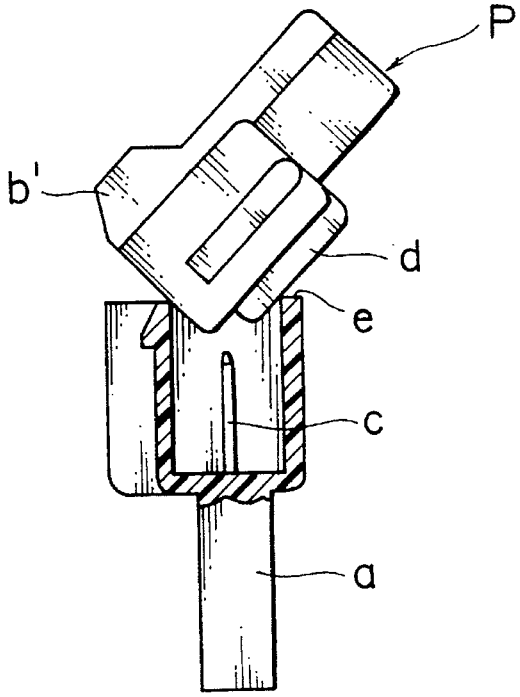
FIG. 5 PRIOR ART
FIG. 5 is a side view, partly in section, of a connector consisting of a pair of conventional pinch preventive connector housings.
Figure 6:
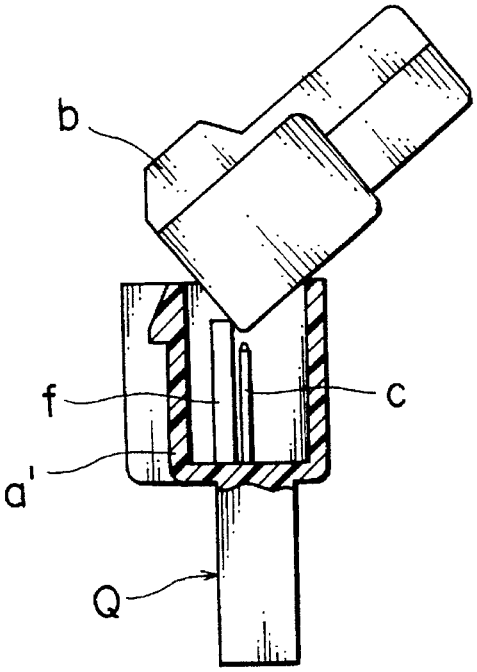
FIG. 6 PRIOR ART
FIG. 6 is a side view, partly in section, of a connector consisting of another pair of conventional pinch preventive connector housings.

If no outer cover portion 3 is provided, as seen in FIG. 3, a male connector housing "M" may be tilted excessively when it is inserted into the female housing "F" as being inclined, then an engaging end portion 4*a'* of the male connector housing "M" hits against the tip end 7*a* of the male electric terminal 7 contained in the female connector housing "F" for causing a problem of pinching the male electric terminal 7.

As shown in the above embodiment, however, in accordance with the present invention, even if the male connector housing "M" is inserted as being inclined, the pinch preventive end 3*b* of the outer cover portion 3 contacts the periphery of the shell 6 of the female connector housing "F" to prevent the male connector housing "M" from tilting any further from a predetermined angle, which is determined by the geometry of the both connector housings, for preventing an excessive insertion of the male connector housing "M", therefore the engaging end portion 4*a* of the male connector housing "M" does not abut the tip end 7*a* of the male electric terminal 7 and causing no pinching.

In accordance with the pinch preventive connector of the present invention, one connector housing is limited to be inserted excessively into the other connector housing even if the both connector housings are engaged with each other in an inclined state. Because of this effect, one connector housing is prevented from hitting against a male electric terminal contained in the other connector housing and then the male electric terminal is protected from pinching without fail.

In addition, it can always be prevented from pinching regardless of the geometry of the engaging portion, therefore, this invention has many advantages as being applicable to connectors having a complicated structural configuration, miniature connectors provided by downsizing structural components, and the like.

It should be understood that the foregoing relates to only a preferred embodiment of this invention, and that it is intended to cover all changes and modifications of the preferred embodiment of this invention, herein chosen for the purposes of the disclosure, which do not depart from the spirit and scope of this invention.

What is claimed is:

1. A pinch preventive connector comprising:

a pair of connector housings engaging with each other;

an outer cover portion having a pinch preventive portion is provided on the periphery of one connector housing; and electric terminals contained in said pair of connector housings, wherein said pinch preventive portion abuts the periphery of the other connector housing for preventing said one connector housing from hitting against the electric terminal contained in the other housing when both connector housings are engaged in an inclined state.

2. The connector as claimed in claim 1, wherein said pinch preventive portion is an end of said outer cover portion.

3. The connector as claimed in claim 1, wherein said outer cover portion is mounted on the periphery of said one connector housing at the non-engaging portion thereof with a vertical base portion.

4. The connector as claimed in claim 1, wherein said outer cover portion is an integral part of said one connector housing.

5. The connector as claimed in claim 1, wherein said outer cover portion is formed into a concave shape in cross section.

6. The connector as claimed in claim 1, wherein said one connector housing is a male connector housing and said other connector housing is a female connector housing.

7. The connector as claimed in claim 1, wherein said electric terminal contained in said other connector housing is a male electric terminal.

* * * * *